United States Patent [19]

McPeak

[11] 4,151,671

[45] May 1, 1979

[54] MECHANISM FOR REMOTELY OPERATING VARIABLE CHOKE DEVICES FOR SHOTGUNS

[76] Inventor: Walter G. McPeak, 3505 Kilkenny West, Tallahassee, Fla. 32303

[21] Appl. No.: 909,164

[22] Filed: May 24, 1978

[51] Int. Cl.[2] ..... F41C 21/00

[52] U.S. Cl. ..... 42/79

[58] Field of Search ..... 42/79

[56] References Cited

U.S. PATENT DOCUMENTS

| | | | |
|---|---|---|---|
| 2,442,899 | 6/1948 | McAllister | 42/79 |
| 2,466,203 | 4/1949 | Bristow | 42/79 |
| 2,600,874 | 6/1952 | Hoza | 42/79 |
| 2,765,564 | 10/1956 | Schroeder | 42/79 |
| 2,807,903 | 10/1957 | Wheeler | 42/79 |
| 2,869,272 | 1/1959 | Coyle | 42/79 |
| 3,161,979 | 12/1964 | Lowe | 42/79 |
| 3,408,762 | 11/1968 | Durao | 42/79 |
| 3,605,313 | 9/1971 | Kranz | 42/79 |
| 3,812,610 | 5/1974 | Kranz | 42/79 |

*Primary Examiner*—Charles T. Jordan

*Attorney, Agent, or Firm*—Robert Brown, Jr.

[57] ABSTRACT

A mechanism for remotely manipulating a rotary adjustable choke device on the muzzle of a shotgun barrel. Specifically, the mechanism consists of a reciprocatory operating arm positioned intermediate the choke device and the breech end of the barrel, in combination with a connection between the arm and device for converting the reciprocatory motion of the former into oscillatory motion of the latter, thereby varying the muzzle constriction and shot pattern. The arm is positioned so that it may be manually reciprocated by the shooter to selected releasable positions corresponding to the desired choke settings and while the gun is held in firing position.

6 Claims, 9 Drawing Figures

MECHANISM FOR REMOTELY OPERATING VARIABLE CHOKE DEVICES FOR SHOTGUNS

This invention relates to apparatus that allows variation of the muzzle constriction and shot pattern of shotguns, and more especially to an auxiliary attachment which enables the shooter to vary the constriction while holding the gun in firing position.

Time is of essence when it becomes necessary for a hunter to adjust the choke setting of a shotgun between two or more successive shots to compensate for the increase or decrease in distance from the gun to the game. Heretofore, various types of remotely operated variable choke devices have been provided wherein the muzzle constriction is effected by imparting reciprocatory sliding movement between a choke sleeve and the barrel muzzle. U.S. Pat. Nos. 2,442,899; 2,807,903 and 3,812,610 are typical examples of such devices.

The conventional reciprocatory sliding types of choke devices have met limited commercial acceptance due, in part, to the instability of the telescopic connection with which micromatic choke settings are difficult to obtain and maintain. Moreover, the sliding types are unsuitable for use in association with the rotary or collet-type of adjustable choke mechanism introduced more than a quarter of a century ago and presently enjoys more popularity than other commercially available models. U.S. Pat. No. 3,161,979 discloses a relatively recent version of the collet-type wherein the degree of muzzle constriction is manually adjusted by rotating a screw-in sleeve at the muzzle of the gun barrel.

But even with the proven merits of the manually adjustable collet-type of choke device, a hunter is required to lower his gun from firing position to make the necessary choke adjustment following an unsuccessful first shot thus permitting the game to flee out of range before the second shot can be fired. In attempts to correct this shortcoming, self-adjusting choke devices have been provided which, after the first shot, automatically change the setting for a longer shot. Powder gas is used to release the outer sleeve and permit it to constrict the choke. The latter type of device is suitable only where the setting for the first shot is for close range and the succeeding shot for a longer range. If the hunter should make an unsuccessful shot for a given distance and then the game comes closer to the hunter, the action of the self-adjusting choke is the reverse of what would be needed.

It is therefore an object of this invention to provide an auxiliary attachment for remotely operating the manually adjustable collet-type of choke device from the breech end of the gun barrel and while the gun is held by the user in firing position.

It is another object of invention to provide an attachment of the class described which includes an elongated arm reciprocably mounted for movement longitudinally of the gun barrel and capable of effecting rotary or oscillatory movement of a screw-in adjustment sleeve of a collet-type of choke device.

Some of the objects of invention having been stated, other objects will appear as the description proceeds when taken in connection with the accompanying drawings, in which, FIG. 1 is a side elevation of a shotgun embodying my attachment for remotely operating a collet-type choke device;

Figures 1, 2, 3, 4, 5, 6:
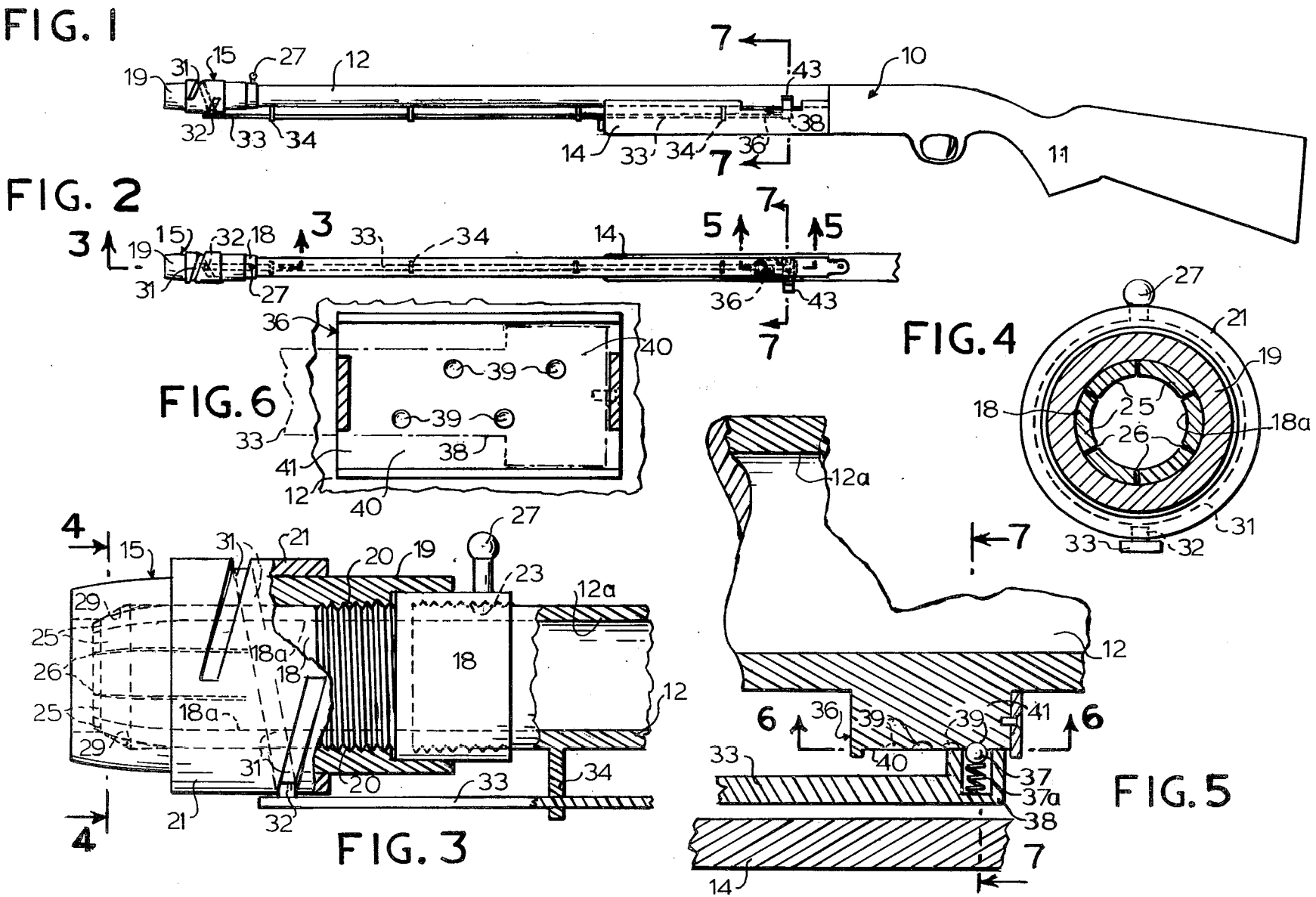
FIG. 2 is a top plan view of the left-hand portion of FIG. 1.
FIG. 3 is a fragmentary longitudinal sectional detail view taken along line 3—3 in FIG. 2, showing the choke device in full-choke position and with portions thereof shown in elevation.
FIG. 4 is an enlarged cross-sectional view taken along line 4—4 in FIG. 3.
FIG. 5 is a fragmentary longitudinal sectional detail view taken along line 5—5 in FIG. 2, showing the detent means for the selected choke settings.
FIG. 6 is a sectional detail view taken along the line 6—6 in FIG. 5.

Referring more particularly to the drawings, the numeral 10 broadly denotes a semi-automatic shotgun composed of stock 11, barrel 12, magazine and/or handgrip 14, and an adjustable choke device broadly designated by numeral 15.

As best shown in FIG. 3, the device 15 comprises a collet-type of choke having a tubular member 18 with a bore **18*a* therein coaxial with bore 12*a* of barrel 12, an outer sleeve 19 threadably mounted on member 18 as at 20, and a collar or annular rib portion 21 integral with the outer periphery of sleeve 19. The rearward end of tubular member 18 is counterbored and fixedly secured to the muzzle of barrel 12 by any suitable means such as threads 23, whereas, the forward end of member 18 is provided with forwardly extending and circumferentially spaced spring fingers 25 having slots 26 therebetween (FIGS. 3 and 4). A front sight 27 is provided on the outer rearward end of member 18**.

Since the threads 20 on member 18 have a right-hand pitch, a clockwise rotation of threadably engaging sleeve 19 (looking rearwardly of the gun barrel) will concurrently impart to this same sleeve 19 a corresponding movement axially of barrel 12 and attachment 15 so as to occupy the full-choke position shown in FIG. 3. Conversely, a counterclockwise rotation of the sleeve 19 will impart to it an axial movement forwardly of the barrel and attachment so as to occupy the unchoked position shown in FIG. 8. In other words, oscillatory motion of the sleeve 19 in either direction about the barrel axis will produce a corresponding motion of the sleeve axially of the barrel. During the rearward longitudinal movement of member 19 from the position shown in FIG. 8 to that shown in FIG. 3, the forward or tip ends of spring fingers will engage frusto-conical cam surface 29 on the inside of the outer end of member 19 to thereby constrict bore **18*a*** in a manner described in the aforementioned U.S. Pat. No. 3,161,979; and forward movement of the member will permit the fingers to spring radially outwardly to the unchoked position.

The present attachment includes means for oscillating the tubular member 19 from a remote location such as near the breech end of the gun barrel and while the hunter holds the gun in firing position, thereby permitting quick choke adjustments between shots. The above-described collar or rib 21 on screw-in sleeve member 19 is provided with a helical closed cam or groove 31 which is slidably engaged by a projection 32 on the forward end of elongated arm 33 extending rearwardly of and slidably attached to the underside of barrel 12 by means of lugs 34.

At the grip 14 located near the breech end of the barrel 12, a detent assembly 36 releasably holds the arm 33 and its associated members 19, 21 in positions corresponding to selected choke settings, said assembly comprising a pair of spring-pressed/balls 37, 37 mounted in the rearward end portion 38 which is slidably engageable with the proximate surface 40 of projection 41 of barrel 12. During said sliding movement, the two balls 37, 37 alternately engage spaced recesses 39 in the surface 40 as arm 33 is moved back and forth longitudinally of the barrel to the selected positions. The staggered arrangement of recesses 39 in two or more parallel rows and the use of two or more alined balls 37 permit micromatic choke setting positions.

Figure 7:
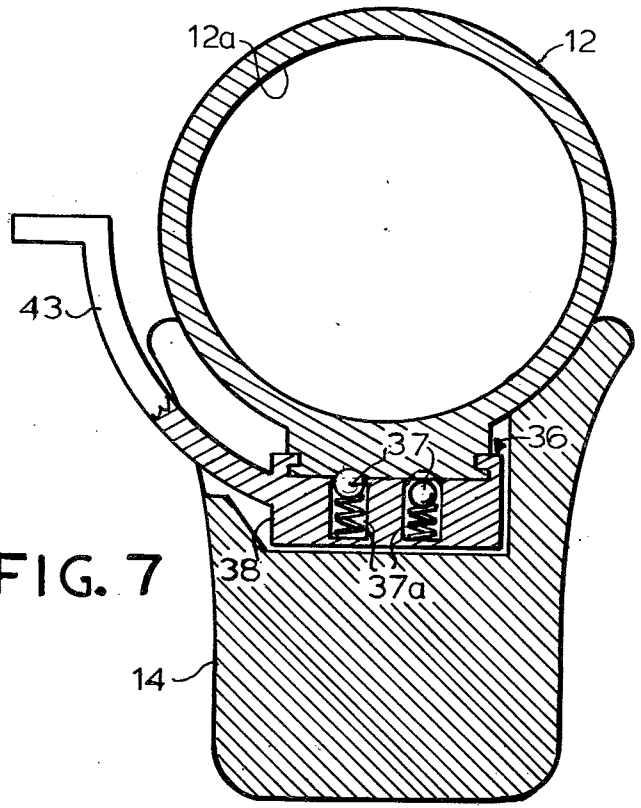
FIG. 7 is an enlarged cross-sectional view taken along lines 7—7 in FIGS. 1, 2 and 5 at the breech end of the gun barrel.
Figure 8:
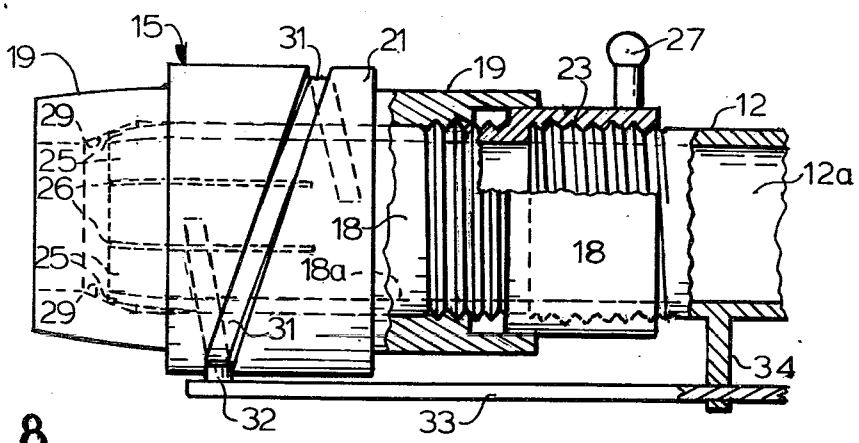
FIG. 8 is a view identical to the left-hand portion of FIG. 3 except the choke device and operating attachment therefor are shown in an unchoked position.

An operating lever 43 projects laterally and then upwardly from the end portion 38 to a position readily engageable by the shooter's thumb or finger while the hand grasps the grip member 14 to assist in holding the gun in firing position (FIGS. 1, 2 and 7). By moving lever 43 rearwardly the desired amount after a first unsuccessful shot at game, the hunter is able to quickly adjust the setting for a second longer or shorter shot as conditions may require. A rearward pull on the lever increases the choking action while a forward push decreases it. The increasing choking action resulting from pulling the arm toward the hunter is made possible by pitching the helical cam groove 31 in an opposite direction to the pitch of thread 20. For example, groove 31 may have a left-hand pitch and thread 20 a right-hand pitch as shown in FIGS. 3 and 8, or vice versa.

In most installations, it is preferable to use oppositely pitched groove 31 and thread 20 since a greater force must be exerted when increasing the choking action due to the resistance offered by the spring fingers 26 while engaging cam surface 29. Therefore, by pulling the lever 43 rearwardly toward the shoulder of the hunter, the gun is less likely to be diverted from the target than when pushed away from his shoulder.

Figure 9:
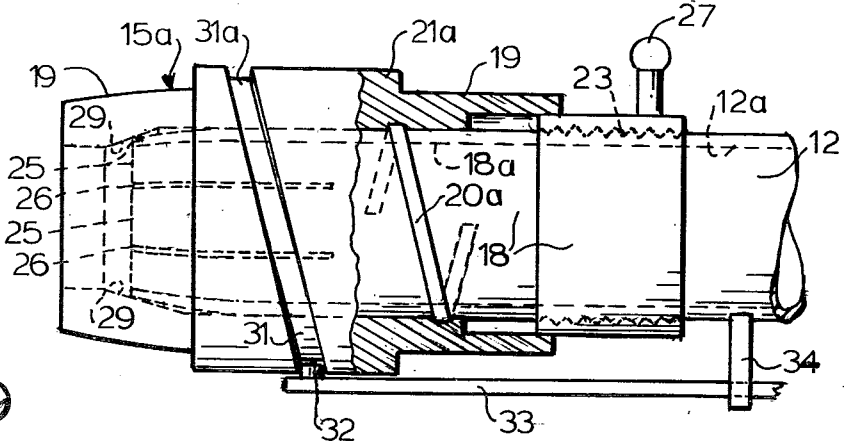
FIG. 9 is a longitudinal sectional view similar to the left-hand portion of FIG. 8, showing a modification of the device.

In FIG. 9, the choke assembly is provided with a collar **21*a* having a right-hand cam groove 31*a* therein and also having a right-hand threaded engagement 20*a* with tubular member 18 thereby causing the choking action to be decreased in response to rearward movement of arm 33** and increased in response to forward movement.

The rib or collar **21*a* is cast as an integral part of sleeve 19 in FIG. 9** where the choke attachment is sold as a part of the gun by the dealer, whereas, it is detached when the attachment is sold for installation on guns previously purchased.

I claim:

1. In combination, a shotgun having a barrel, a tubular member forming an extension of the muzzle of said barrel, means threadably mounted on said member and rotatable about the axis of the barrel for varying the constriction at said muzzle, an elongated arm mounted for reciprocable movement longitudinally adjacent said barrel, and means responsive to the reciprocable movement of said arm for imparting rotary movement to said threadably mounted means to thereby increase or decrease said muzzle constriction.

2. The combination defined in claim 1 wherein said responsive means includes a second tubular member, said second member having a cam surface on its outer periphery, and a cam follower integral with the forward end of said arm for slidably engaging said cam surface.

3. The combination defined in claim 1 wherein said tubular member is provided with a plurality of circumferentially spaced fingers cantilevered forwardly therefrom, and wherein said responsive means includes a second tubular member threadably mounted on said first member and provided with a helical groove in its outer periphery, and a projection on the forward end of said arm for slidably engaging said groove, and further comprising cam means on the inner periphery of said second member for slidably engaging the free ends of said fingers to vary the muzzle constriction.

4. The combination defined in claim 3 wherein said helical groove is pitched in a direction opposite the the pitch of the threaded connection between said first and second members.

5. The combination defined in claim 3 wherein said helical groove and said threaded connection between said first and second members are pitched in the same direction.

6. The combination defined in claim 1 and further comprising detent means for releasably holding said arm in positions corresponding to selected choke settings, said detent means including a projection on said gun, a row of spaced recesses on said projection, a parallel row of spaced recesses staggered with the recesses in said first row, and a pair of alined spring-pressed balls carried by said arm and alternately engageable with the recesses in said rows as the arm is reciprocated.

* * * * *